US008529229B2

(12) United States Patent
Asai et al.

(10) Patent No.: US 8,529,229 B2
(45) Date of Patent: Sep. 10, 2013

(54) INK JET PRINTING APPARATUS

(75) Inventors: Yasuyuki Asai, Tokyo (JP); Masaaki Matsuura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 697 days.

(21) Appl. No.: 11/839,914

(22) Filed: Aug. 16, 2007

(65) Prior Publication Data

US 2008/0049064 A1 Feb. 28, 2008

(30) Foreign Application Priority Data

Aug. 23, 2006 (JP) ..... 2006-227182

(51) Int. Cl.
*F04B 43/08* (2006.01)
*F04B 43/12* (2006.01)

(52) U.S. Cl.
USPC ..... 417/477.8; 417/477.7

(58) Field of Classification Search
USPC ..... 347/30, 84, 85; 417/477.6, 477.7, 417/477.8, 474, 475, 477.1, 477.3
See application file for complete search history.

(56) References Cited

U.S. PATENT DOCUMENTS 1,703,361 A * 2/1929 Pohl ..... 137/565.12
4,142,845 A * 3/1979 Lepp et al. ..... 417/477.8
4,576,556 A * 3/1986 Thompson ..... 417/477.12
4,586,882 A * 5/1986 Tseng ..... 417/477.3
5,037,274 A * 8/1991 Holmes et al. ..... 417/53
5,064,358 A * 11/1991 Calari ..... 417/475
5,340,290 A * 8/1994 Clemens ..... 417/477.1
6,109,740 A * 8/2000 Namekawa et al. ..... 347/85
6,164,767 A * 12/2000 Nakamura et al. ..... 347/85
6,203,295 B1 * 3/2001 Nishioka ..... 417/476
6,641,249 B2 * 11/2003 Miyauchi ..... 347/30
6,733,255 B2 * 5/2004 Ota et al. ..... 417/477.7
6,743,204 B2 * 6/2004 Christenson et al. ..... 604/151
2001/0019344 A1 * 9/2001 Harada et al. ..... 347/30
2004/0141863 A1 * 7/2004 Harada et al. ..... 417/476

FOREIGN PATENT DOCUMENTS

JP 6-198902 7/1994
JP 2001-063093 3/2001
JP 2001-355580 12/2001
JP 2002-036601 2/2002
JP 2002-211009 A 7/2002

OTHER PUBLICATIONS

Notification of First Office Action (Appln. No. 2007101461607, Chinese Patent Office, issued May 8, 2009).
Japan Patent Office, Office Action, Jul. 8, 2011 (issued in counterpart Japanese patent application No. 2006-227182).

* cited by examiner

*Primary Examiner* — Charles Freay
*Assistant Examiner* — Alexander Comley
(74) *Attorney, Agent, or Firm* — Fitzpatrick, Cella, Harper & Scinto

(57) ABSTRACT

A tube pump reduced of the burden against pump driving caused by dragging of a tube by a pressurizing roller. Specifically, guide members are disposed in the respective introduction portions at between the guides. Namely, the guide members are arranged nearby the extensions of the circumference of the arcuate guides and radially with respect to the center of the circumference. Due to this, the pump tube, the roller is to drag, is sustained by the guide member, to prevent the tube from increasing its deformation due to dragging. Thus, the tube can be prevented from being dragged in a manner forming a resistance to the roller. As a result, the pump motor, etc. can be prevented from being burdened with an increasing load.

9 Claims, 18 Drawing Sheets

INK JET PRINTING APPARATUS

BACKGROUND OF THE INVENTION

1. Field of the Invention

The present invention relates to an ink jet printing apparatus, and more particularly to a tube pump for use in an ejection recovery operation to maintain and recover the ejection performance of a printing head for ejecting ink.

2. Description of the Related Art

As printing apparatuses used on printers, copiers, facsimile machines, etc. or used as output devices for computers, ink jet printing apparatuses, which performs printing by ejecting ink onto a printing medium such as a paper, are in widespread use. On the other hand, there are various demands for the material of a printing medium for use on the apparatuses. In order to meet the demands, it is a recent practice to supply a printing apparatus on which cloth, leather, non-woven fabric metal or the like is to be used as a printing medium besides the usual printing medium of a paper, an OHP sheet or the like.

The ink jet printing apparatuses are advantageous because of low noise and running cost and easiness to reduce the size and use with colors, and hence broadly applied on printers, copiers, facsimile machines, etc. The ink jet printing apparatus is provided with a printing head having ejection openings through which ink is to be ejected. The ejection opening has a diameter of approximately several tens micrometers, and it is a recent tendency to reduce ejection opening size as print image quality is improved. The ink jet printing apparatus is to eject ink through fine ejection openings during printing, and thus clogging possibly occurs in the ejection opening thus resulting in defective ejection, e.g. failure to eject ink. When the defective ejection occurs, the resulting image is possibly lower in quality.

As a countermeasure against the defective ejection, it is a usual practice to carry out a recovery operation in order to maintain and recover the ink ejection performance of the printing head. As such recover operations, suction recovery is known in which ink is drawn out of the printing head by suction. The suction recovery includes operations to cap the ejection opening of the printing head with a cap and to cause negative pressure at the inside of the cap through the action of pumping in the capping state. This causes foreign matters such as viscous ink, bubbles to be drawn through the ejection openings of the printing head, to refresh the ink inside the ejection openings. Incidentally, as another type of recovery operation, wiping is also known to wipe and clean away foreign matters such as ink put on the ejection opening face of the printing head, subsequently to the suction recovery.

Those pumps for the suction recovery include a tube pump that generates negative pressure by utilization of the volume change at the inside of its elastic tube. More specifically, a volume change within the tube caused by pressing the tube in one direction by use of a roller or roller moving along the tube, causes negative pressure to be produced at the rear of the tube being pressed. Then, by the connection of the tube with the cap covering the ejection opening face of the printing head, ink is drawn out of the printing head through utilization of the negative pressure caused in the tube.

As a prior art of the tube pump, Japanese Patent Laid-Open No. 2001-063093 describes a structure that a tube is sandwiched between rollers in the number of n ($N \leqq 3$) arranged in a peripheral edge of a rotary member and squeeze surfaces in the number of (n−1) or less, which are located opposite to the rollers and at the outside of the periphery of the rotary member, and the rotary member is rotated. In this structure, by rotating the rotary member, the rollers continuously press the tube against the squeeze surfaces to generate negative pressure.

Furthermore, Japanese Patent Laid-Open No. 6-198902 (1994) and Japanese Patent Laid-Open No. 2001-355580 describe similar structures using a plurality (N) of tubes arranged in a manner dividing, into equal parts, the inner peripheral surface of the pump case. By moving pressurizing rollers in the number of (N+1) arranged in a manner dividing into equal parts the circumference about a pump drive shaft, the tubes are deformed under pressure thereby causing pumping.

In the tube pump described in the above two prior arts, there exists portions where the two tubes are introduced on a path along which the rollers rotatively move. More specifically, there exists two introduction portions where tubes are introduced into the pump case and where the pressing by the roller is terminated. FIG. 18 is a view showing typical one form of the same. The pump shown in FIG. 18 has an inner peripheral surface of pump case 80 that is divided into two equal parts wherein elastic tubes 81, 82 are arranged along the respective ones of the inner peripheral surface. The roller holder 84, guiding the rotation shafts of three pressurizing rollers 83*a*, 83*b*, 83*c*, is to rotate in the arrow direction in the figure thereby causing a pumping operation. In the FIG. 18 example, two introduction portions 80*a*, 80*b* exist based on the two tubes.

The tube pump having such a plurality of tubes is for use in a suction structure that a plurality of tubes are respectively connected to a plurality of separate caps. This eliminates the necessity of providing tube pumps correspondingly to the number of caps, thus contributing to apparatus size reduction, etc.

However, the tube pump, having tube introduction portions, involves the following problems.

Firstly, in the example of FIG. 18, as the pressurizing roller 83*a* moves toward the introduction portion 80*b*, the roller 83*a* may drag the tube 81 in a direction of the movement while pressing the tube. As a result, the motor rotating the pressurizing rollers problematically has an increased load thereon. The problem of such a load increase becomes noticeable in the case where the motor used is small in size and output as used on the small-sized printer.

Secondly, there is a possibility to raise the following problem even where a certain countermeasure is taken against the first problem in a manner not to drag the tube. Likewise, in the example shown in FIG. 18 example, when the pressurizing roller 83*a* moves to the introduction portion 80*b* and begins reducing the pressing force on the tube, the pressurizing roller 83*a*, in turn, may be rebounded by the restoration force of the tube 81. In this case, the rebounded pressurizing roller 83*a* hits against a part of the groove on the roller holder 84 that holds the shaft of that roller. As a result, the pressurizing roller 83*a* temporarily takes a position unstable relative to the roller holder 84. Then the unstable pressurizing roller constitutes a cause of poor suction. In addition, the hitting sound caused by the above hitting raises noise upon driving the pump. It may be considered to use a buffer member in order to decrease such noise. This however results in a problem of cost increase because of the difficulty in the manufacture in addition to the increasing number of components.

Incidentally, the above problem is not limitedly encountered in the pump using such a plurality of tubes as disclosed in Japanese Patent Laid-Open No. 2001-063093, Japanese Patent Laid-Open No. 6-198902 (1994) or Japanese Patent Laid-Open No. 2001-355580. It is apparent from the above that the problem of dragging at the tube introduction portion or rebounding by the tube is to occur even on such a pump using one tube as described in Japanese Patent Laid-Open No. 2002-036601.

SUMMARY OF THE INVENTION

An object of the present invention is to provide an ink jet printing apparatus including a tube pump which is capable of reducing the load against pump drive as caused by dragging the tube and of preventing the tube from rebounding the roller.

In the first aspect of the present invention, there is provided an ink jet printing apparatus that uses a printing head and ejects ink onto printing medium from the printing head to perform printing, the apparatus comprising: a tube pump for causing a pressure change of ink in an ink ejection opening of the printing head to move the ink, the tube pump including a tube, a roller holder which holds a roller and is provided so that the roller holder is rotatable while the roller pressing the tube, and a tube guide receiving the tube pressed by the roller to maintain positional relationship with the roller pressing the tube, wherein the tube pump includes an introduction portion through which the roller move and at which the tube is introduced from an outside of the tube pump and pressing force by the roller decreases, and is provided with a guide member for contacting with the tube at a neighborhood of the introduction portion so as to prevent the tube from being deformed by movement of the roller while the roller pressing the tube.

Preferably, there is provided an ink jet printing apparatus, wherein the roller holder has a groove engaging with a rotation shaft of the roller, the roller is moved by rotation of the roller holder and a movement of the roller relative to a cam surface of the groove through the rotation shaft, and the groove has a pressing position of the cam surface that defines a position of the roller where the roller presses the tube and a distance of an outer peripheral surface of the roller to the receiving surface of the tube guide is $\beta$, and an over-pressing position of the cam surface that defines a position of the roller where the distance of the outer peripheral surface of the roller to the receiving surface of the tube guide continuously increases from the pressing position to be $\alpha$ ($\alpha<\beta$).

In the second aspect of the present invention, there is provided a tube pump comprising: a tube, a roller holder which holds a roller and is provided so that the roller holder is rotatable while the roller pressing the tube, and a tube guide receiving the tube pressed by the roller to maintain positional relationship with the roller pressing the tube, wherein the tube pump includes an introduction portion through which the roller move and at which the tube is introduced from an outside of the tube pump and pressing force by the roller decreases, and is provided with a guide member for contacting with the tube at a neighborhood of the introduction portion so as to prevent the tube from being deformed by movement of the roller while the roller pressing the tube.

Preferably, there is provided a tube pump, wherein the roller holder has a groove engaging with a rotation shaft of the roller, the roller is moved by rotation of the roller holder and a movement of the roller relative to a cam surface of the groove through the rotation shaft, and the groove has a pressing position of the cam surface that defines a position of the roller where the roller presses the tube and a distance of an outer peripheral surface of the roller to the receiving surface of the tube guide is $\beta$, and an over-pressing position of the cam surface that defines a position of the roller where the distance of the outer peripheral surface of the roller to the receiving surface of the tube guide continuously increases from the pressing position to be $\alpha$ ($\alpha<\beta$).

According to the above structure, the pump tube being dragged by the roller is sustained by the guide member, thereby preventing the tube from being increasingly deformed by the dragging and hence preventing such tube dragging as causing a resistance to roller movement. As a result, loads increase can be prevented upon the pump motor, etc.

Further, the groove has a cam surface that increases continuously from a point, at which the roller is in a pressing position with a distance $\beta$, and reaches an over-pressing position with a distance $\alpha$. In this mariner, the cam surface can be made with such a profile that an over-pressing position (with the maximum distance), which causes an over-pressing state, exists next to the pressing position of the roller pressing the tube. This makes the roller, which tries to move by rebound force from the tube, be sustained by the cam surface connecting between the pressing position and the over-pressing position. That is, the roller, being moved by the rebound force, can be prevented from moving by the cam surface formed increasing in distance. As a result, the roller can be gradually released from the engagement with the tube while being substantially held in the pressing position. Thus, the roller can be prevented from moving abruptly or causing impact sound resulting therefrom.

Further features of the present invention will become apparent from the following description of exemplary embodiments (with reference to the attached drawings).

DESCRIPTION OF THE EMBODIMENTS

With reference to the drawings, description will be now made on embodiments according to the present invention.

Figure 17:
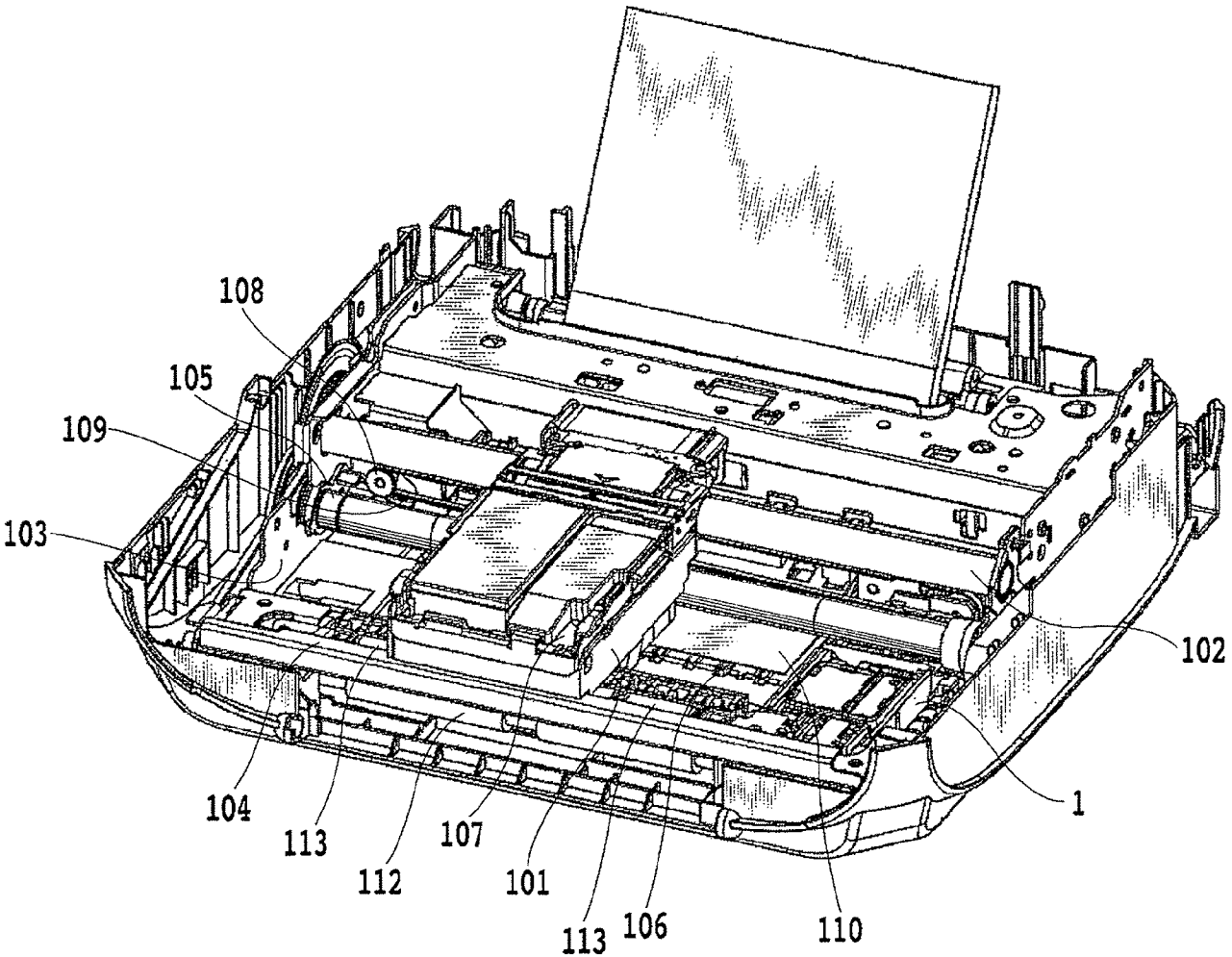
FIG. 17 is a perspective view showing an example of an ink jet printing apparatus having a recovery unit according to the first embodiment of the invention.

FIG. 17 is a perspective view showing an embodiment of an ink jet printing apparatus provided with a recovery unit to which the invention is applied. In FIG. 17, a carriage 101 is movably supported over a guide shaft 102 and guide rail 104. The carriage 101 is allowed to reciprocate by the drive force of a carriage motor 108 transmitted through a belt 109. A printing head 107 is mounted on the carriage 101 and can be subjected to a scanning operation by the reciprocation thereof. A printing paper 110 as printing medium, when conveyed, is held by a feed roller 105 and a pinch roller (not shown) and by an exit roller 112 and an exit auxiliary roller 113. The printing paper 110 is conveyed by rotating the feed roller 105 and the exit roller.

In a printing operation, the carriage 101 at rest is accelerated into a constant speed of movement. In the scan movement, the printing head 107 is driven to eject ink toward the printing paper 110, according to the printing data supplied to the printing apparatus. After completing once scanning of driving to the printing head 107, the carriage 101 is decelerated into a rest. Between successive scans, the feed roller 105 is rotated to feed a predetermined amount of printing paper 110. After completing the feeding, the carriage 101 is moved again. In the movement, the printing head 107 is driven to print data on the next line. The series of operations allow for printing all the printing data being concerned. The printing is to be completed by discharging the printing paper 110 to an outside of the printing apparatus through the exit roller 112.

The printing head 107 is of an ink jet type capable of ejecting ink by the utilization of heat energy, in which an electro-thermal converter is provided to generate thermal energy. Specifically, the printing head 107 eject ink through utilization of the pressure change (state change) of bubble growth and contraction caused through film-boiling by means of the heat energy applied by the electro-thermal converter.

In FIG. 17, a recovery unit 1 is arranged in a predetermined location off the zone the printing head is allowed to print, to prevent the clogging in the printing head 107 and maintain/recover the ink ejection performance of the head. The recovery unit 1 has a cap for capping the ejection opening face of the printing head, in order to protect the printing head 107 when not in service or to prevent the evaporation of ink through ejection openings. Further, when printing is performed after a long term of the capping for example, suction recovery is made to draw ink under pressure out of the ejection opening, in order to stabilize ink ejection by removing the ink solidifying (thickening) at and around the ejection opening before printing. The suction recovery is made by operating the pump connected to the cap in a capping state. For this purpose, a tube pump is provided, referred later in the embodiments.

(First Embodiment)

Figure 1:
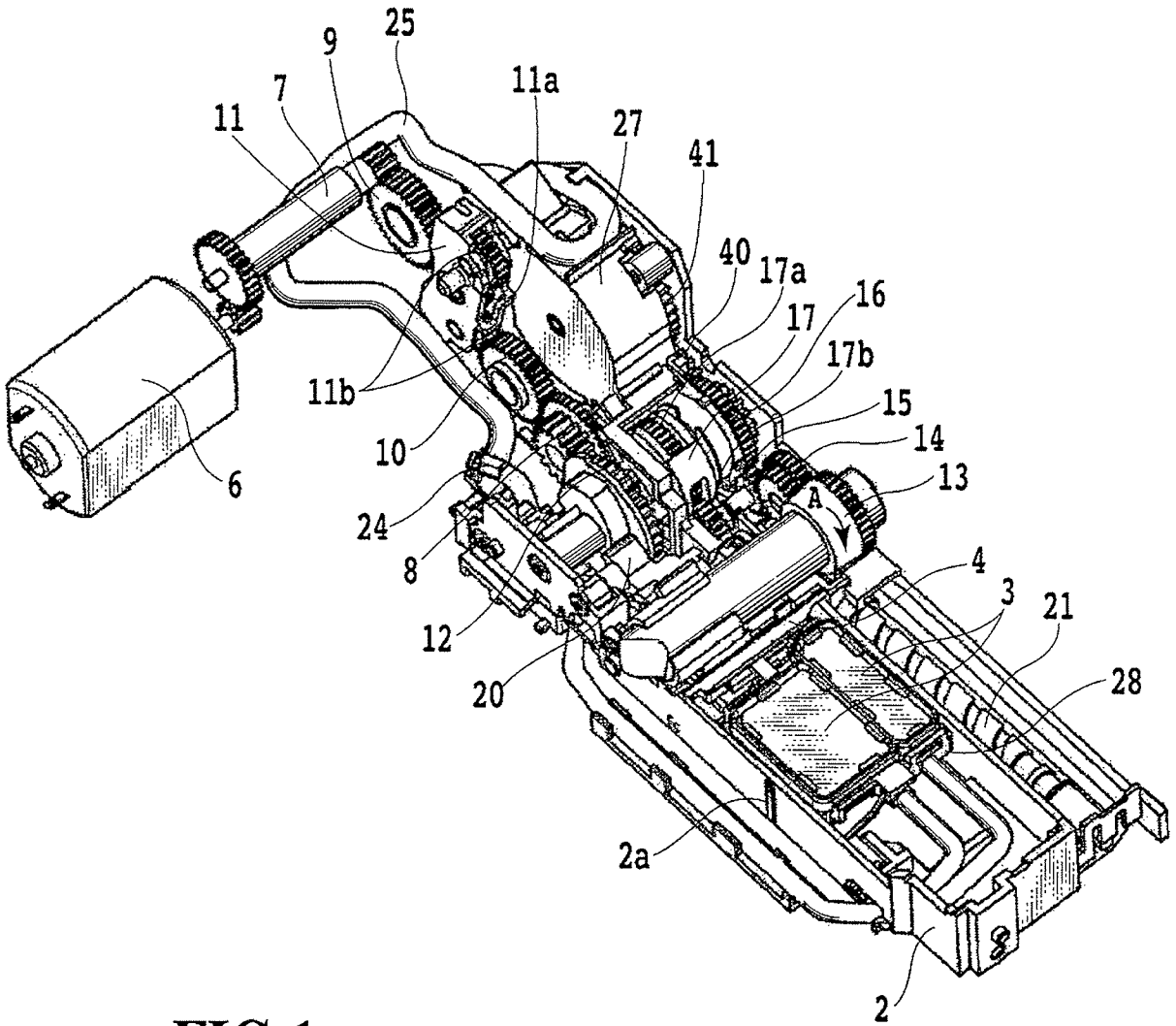
FIG. 1 is a schematic perspective view showing a recovery unit according to a first embodiment of the invention.
Figure 2:
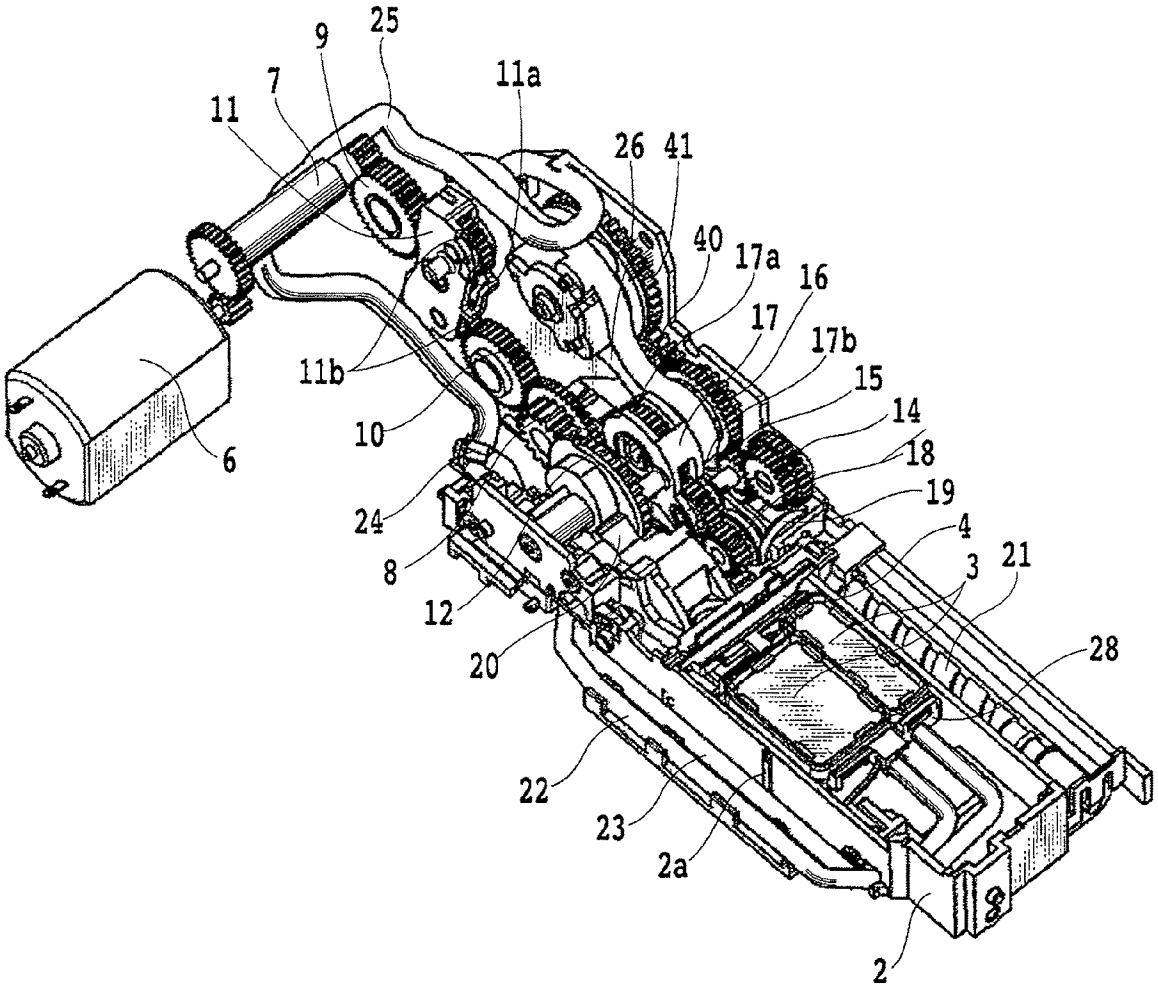
FIG. 2 is a perspective view showing the FIG. 1 recovery unit removed of various cases including that of a recovery pump thereof.

FIG. 1 is a schematic perspective view showing a recovery unit according to a first embodiment of the invention. FIG. 2 is a perspective view showing the FIG. 1 recovery unit removed of various cases including that of the recovery pump. In FIGS. 1 and 2, the recovery unit 1 has two caps 3 that move vertically along the guides 2*a* of the respective bases 2. This allows for respectively capping the two ejection opening faces of the printing head (not shown). Further, a wiper 4 is provided on a lead screw 21, in a manner to reciprocate the wiper. This allows the wiper 4 to wipe the ejection opening face of the printing head. Furthermore, a carriage lock mechanism (not shown) is rotatably provided on the feed roller 105. This prevents the carriage (not shown) from unintentionally moving where the cap 4 caps the ejection opening face.

The cap 3 and the carriage lock mechanism operate as in the following manner. The force of a motor 6 is transmitted through two double gears 7, 8, two idler gears 9, 10 and a swinger 11 made by a sun gear 11*a* and a planetary gear 11*b*. On this occasion, the operation is performed by rotating a main cam 12 only through rotating the motor 6 in one direction through a swinger 11. Further, reciprocating the wiper 4 is as in the following. The force by a not-shown paper-feed motor rotates the input gear 13 attached to a shaft of a feed roller 105. The force is transmitted through a double gear 14, an idler gear 15, a sun gear 17*a* provided on a shaft of a double gear 16, a swinger 17 made by a planetary gear 17*b*, a bevel double gear 18, a bevel gear 19, and a lead screw 21 in phase with the bevel gear 19. On this occasion, the wiper 4 is reciprocated by rotating the lead screw 21 through rotating the feed motor forward and backward. Here, the main cam 12 is formed with a plurality of cams lengthwise (axially) thereof. Due to this, the rotation of the main cam 12 is charged into a movement of the swinger 17*c* through one cam and a boss 17*c* at a side surface of the swinger 17, to couple the planetary gear 17*b* and the bevel double gear 18 together in predetermined timing. By means of another cam and a lever 20, the rotation of the main cam 12 is changed into a vertical reciprocation of the carriage lock means and cap 3.

The two caps 3 are structured in one body wherein cap tubes 22, 23 are respectively connected to the two caps. The cap tube 22 is connected to a pump tube 25 through a joint 24 while the cap tube 23 is to a pump tube 26 through a joint, not shown. The pump tubes 25, 26 are arranged along circular arcuate guide portions 27*a*, 27*b* formed in a part of a pump base 27, thereby making up a tube pump. The other ends of the cap tubes 22, 23 are in communication with an interior of the corresponding cap 3 through a cap holder 28. This allows the tube pump to be operated to draw ink out of ejection openings, in a state the caps cover the ejection opening face of the printing head 107. By the suction, viscous portions of ink, bubbles, etc. are to be expelled out of the printing head. The waste ink is discharged to a predetermined site outside the recovery unit 1 through the other ends of the pump tubes 25, 26.

Figure 3:
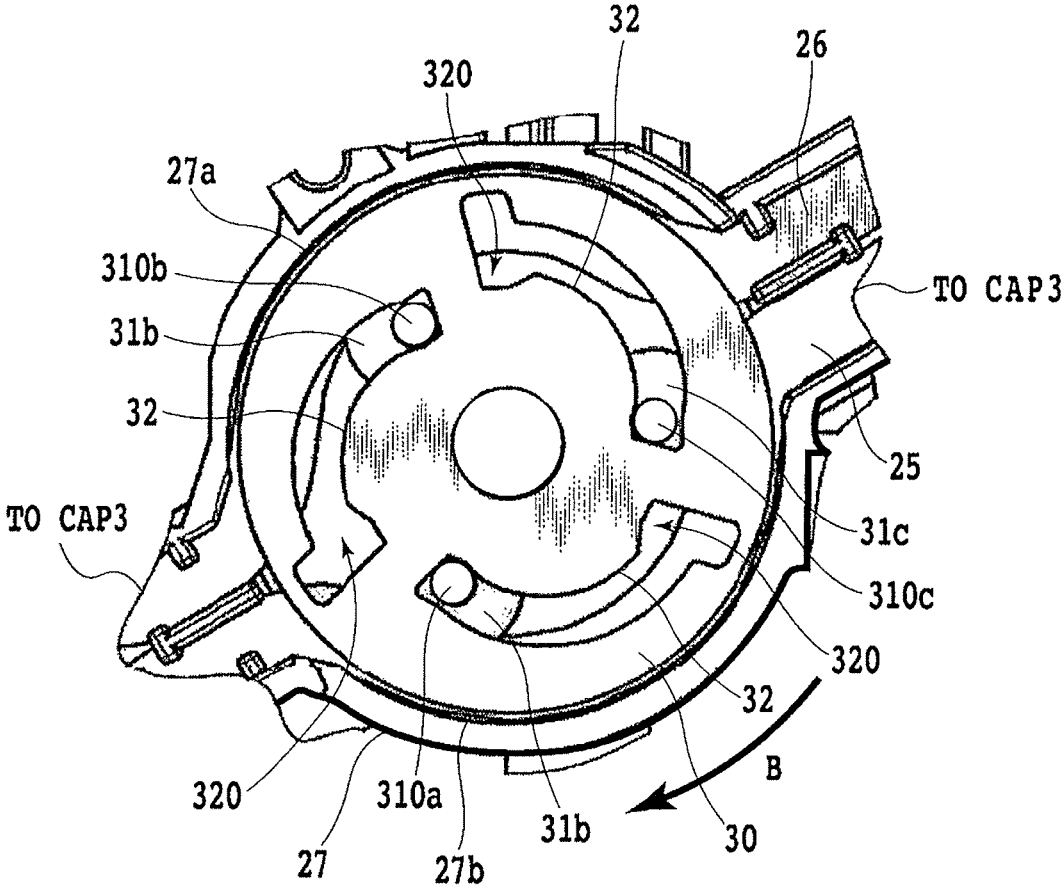
FIG. 3 is an exterior view showing a tube pump of the recovery unit.

FIG. 3 is an exterior view showing the tube pump in the recovery unit 1. In FIG. 3, in the pump base 27, there is rotatably provided a roller holder 30 having an axis common to a center of circular arcuate guide surfaces 27*a*, 27*b* forming a part of the pump base 27. The roller holder 30 is a disk-like member which holds three rollers (pressurizing rollers or rollers) 31*a*, 31*b*, 31*c* at circumferential locations so as to be able to rotate. Specifically, shafts 310*a*, 310*b*, 310*c* of the respective rollers are engaged with respective grooves 32 formed in the roller holder 30 so as to enter in the respective grooves. The tube pump is provided with a rotatable plate member similar to the roller holder 30, on its plane opposite to the plane on which the roller holder 30 is provided. More specifically, the plate member does not have grooves like those of the roller holder 30 but has a contour identical in form to the inner and radial portions of the grooves. By the plate member and the roller holder 30, the shafts 310*a*, 310*b*, 310*c* of the three rollers are supported. Furthermore, in a space defined by the guide surfaces 27*a*, 27*b*, the roller holder 30 and the plate member, there are laid the tubes 26, 25 respectively in a manner extending along the guide surfaces 27*a*, 27*b*. The two tubes extend to the outside of the pump through two introduction portions. By rotatably sliding the roller shafts 310*a*, 310*b*, 310*c* in the respective grooves through rotation of the roller holder 30, the rollers can be operated to press the tubes or so, as referred later. Incidentally, a case member is provided to cover the surfaces of the roller holder 30 and the plate member provided in back thereof.

The roller holder 30 rotates in the following manner. The drive force of the feed motor is transmitted to a pump gear 41 fixed at one end of the roller holder 30 through the input gear 13, the double gear 14, the idler gear 15, the double gear 16 and the idler gear 40. Then the roller holder 30 is rotated by the drive force. In this embodiment, by rotating the roller holder 30 on one direction, the rollers 31*a*, 31*b*, 31*c* act to press the pump tubes 25, 26 to draw ink.

When the feed motor is driven to rotate the input gear 13 in an arrow A direction (FIG. 1), the tube pump (roller holder 30) operates. On this occasion, the cap 3 and carriage lock mechanism, to be driven separately, stays at rest. Further, during a suction operation, the main cam 12 stays in a position at which the connecting is cut off between the planetary gear 17*b* and the bevel double gear 18. Consequently, the wiper 4 under the same drive does not operate. When the feed motor rotates in a reverse direction, the rollers 31*a*, 31*b*, 31*c* release the pump tubes 25, 26 from pressed thus placing the tube pump in a state not to draw ink.

In FIG. 3, when the roller holder 30 rotates in an arrow B direction in the figure, in a state the cap 3 covers the printing head 107, the rollers 31*a*, 31*b*, 31*c* move rotating along the respective tubes while pressing the tubes 25, 26. This causes negative pressure in the tubes. The negative pressure is introduced into the space defined between the printing head 107 and the cap 3, thereby lowering the pressure therein. Thus, ink is drawn out of the printing head 107 through the ejection openings. The ink drawn is moved through the pump tubes 25, 26 by the movement of the rollers 31*a*, 31*b*, 31*c* rotating together with the roller holder 30, and finally discharged to the outside through the other ends of the pump tubes 25, 26. When the rollers 31*a*, 31*b*, 31*c* further rotate together with the roller holder 30 and come to the introduction portion of the pump tube lying between the guides 27*a* and 27*b* of the pump base 27, those become not pressing the pump tubes 25, 26. In this roller operation, when one roller becomes no longer pressing the pump tube 25, 26, another roller begins pressing the pump tubes. This allows for continuous drawing of ink. In addition, by increasing the rotation speed of the roller holder for continuous suction, the negative pressure can be increased.

FIGS. 4 to 12 are schematic sectional views respectively showing the operation stages of the tube pump shown in FIG. 3.

Figure 4:
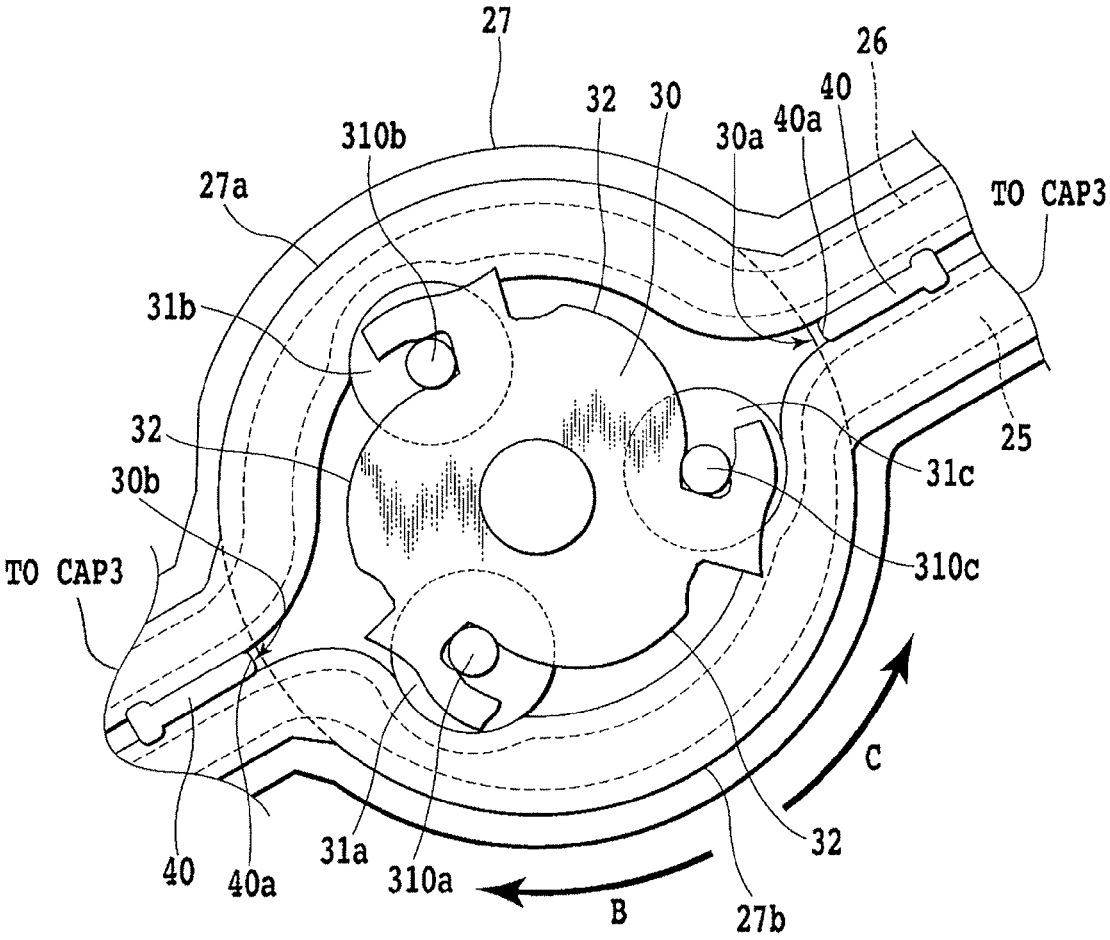
FIG. 4 is a schematic sectional view showing the operation of the tube pump in a state the pump tube is open.

A state shown in FIG. 4 is that the pump tubes 25, 26 are open. In this state, when the roller holder 30 is rotated in the arrow B direction by the feed motor, the rollers 31*a*, 31*b*, 31*c* are rotated by the rotation while maintained the open sate. Incidentally, in this case, the grooves of the roller holder 30 less change in positional relationship with the roller shafts 310*a*, 310*b*, 310*c*.

Figure 5:
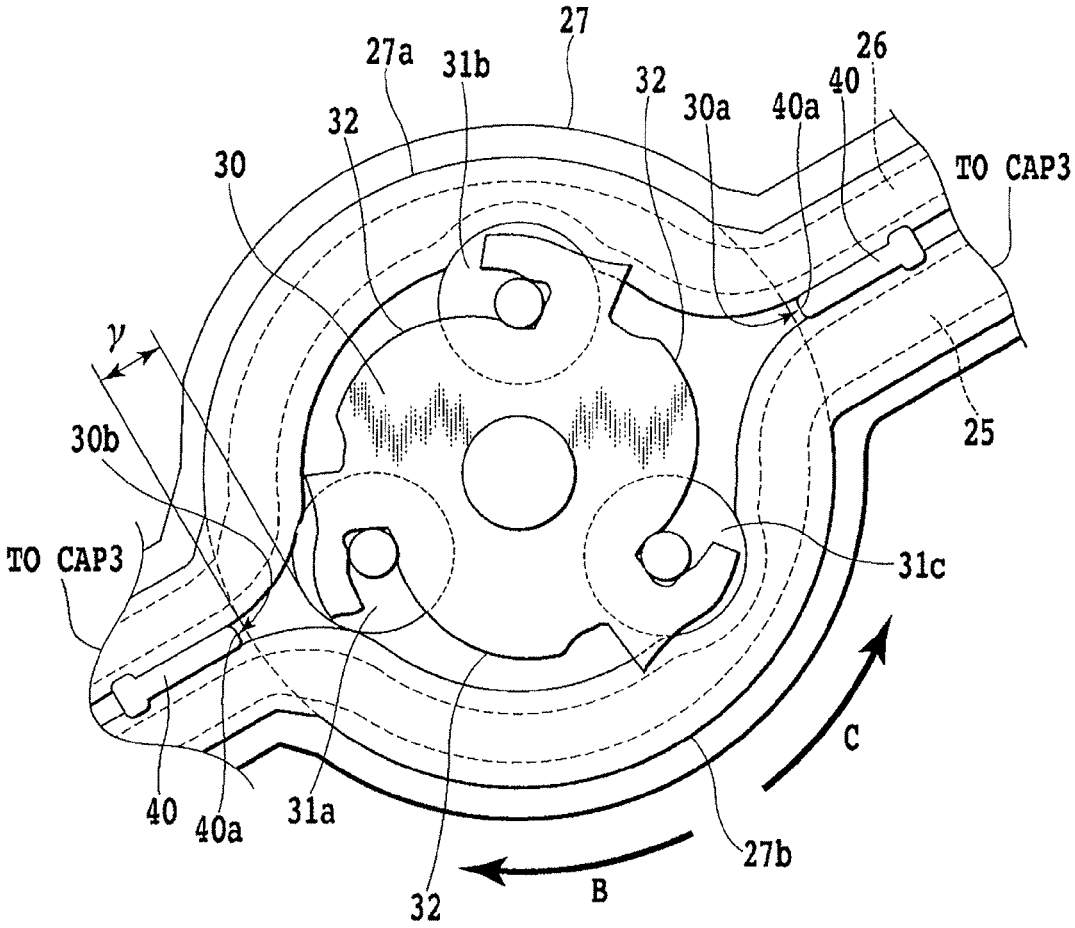
FIG. 5 is a schematic sectional view showing the operation of the tube pump in a state one pressurizing roller lies at an introduction portion of two tube guides due to rotation from FIG. 4 state.

By the rotation, the state changes from that shown in FIG. 4 into a state shown in FIG. 5. More specifically, the roller 31*a* comes in a position at the introduction portion 30*b* lying between the arcuate guides 21*a* and 27*b*, thus being placed in contact simultaneously with the adjacent two pump tubes 25, 26.

Figure 7:
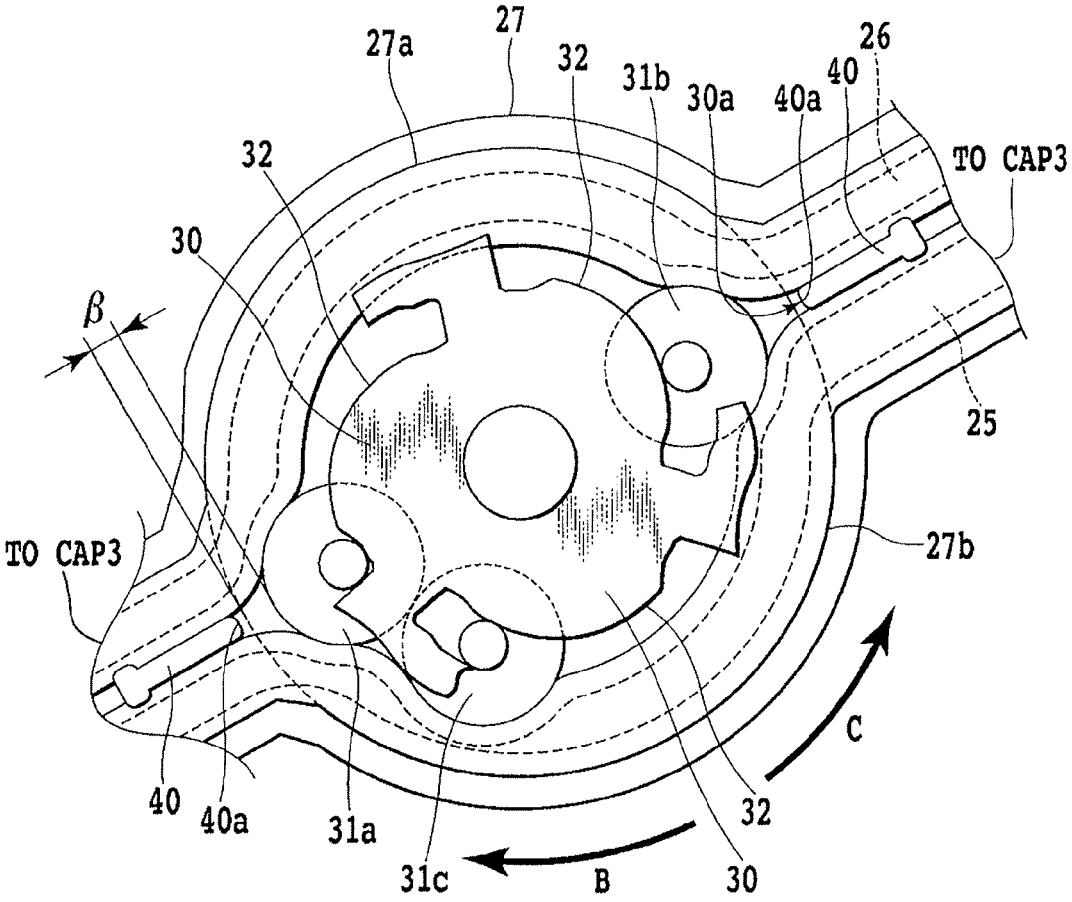
FIG. 7 is a schematic sectional view showing the operation of the tube pump in a state at a start of pressing of one roller on the tube.
Figure 8:
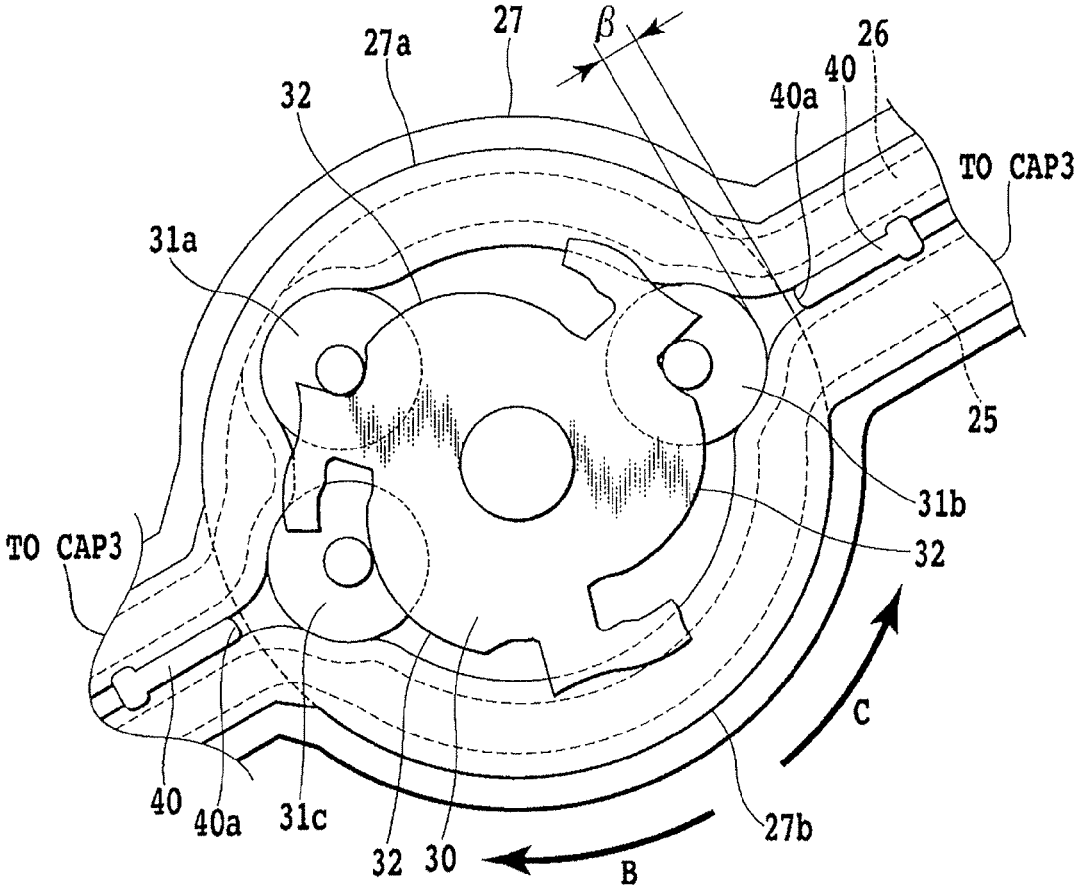
FIG. 8 is a schematic sectional view showing the operation of the tube pump in a state that one roller presses down and squeezes the tube by the cam action of a guide groove.

In this state, when the roller holder 30 further rotates in the arrow B direction, the grooves of the roller holder 30 change in positional relationship with the roller shafts 310*a*, 310*b*, 310*c*. Particularly, the roller shaft located at the introduction portion relatively moves to the other end 320 (FIG. 3) of the groove 32. By the rotation of the roller holder 30 in the arrow B direction, the roller at the introduction portion moves, in order, into the states shown in FIGS. 7 and 8 relatively to the tube. More specifically, as shown in FIG. 7, the roller 31*a* begins pressing the tube 26. Then, as shown in FIG. 8, the roller 31*a* is urged toward the tube 26 by the cam action of the inner portion of the guide groove 32. The tube 26 becomes a state pressed (sealed under pressure) between the roller 31*a* and the guide 27*b*. In this state, as the roller holder 30 rotates in the arrow B direction and the roller 31*a* squeezes the pump tube 26, negative pressure arises within the tube 26.

Figure 9:
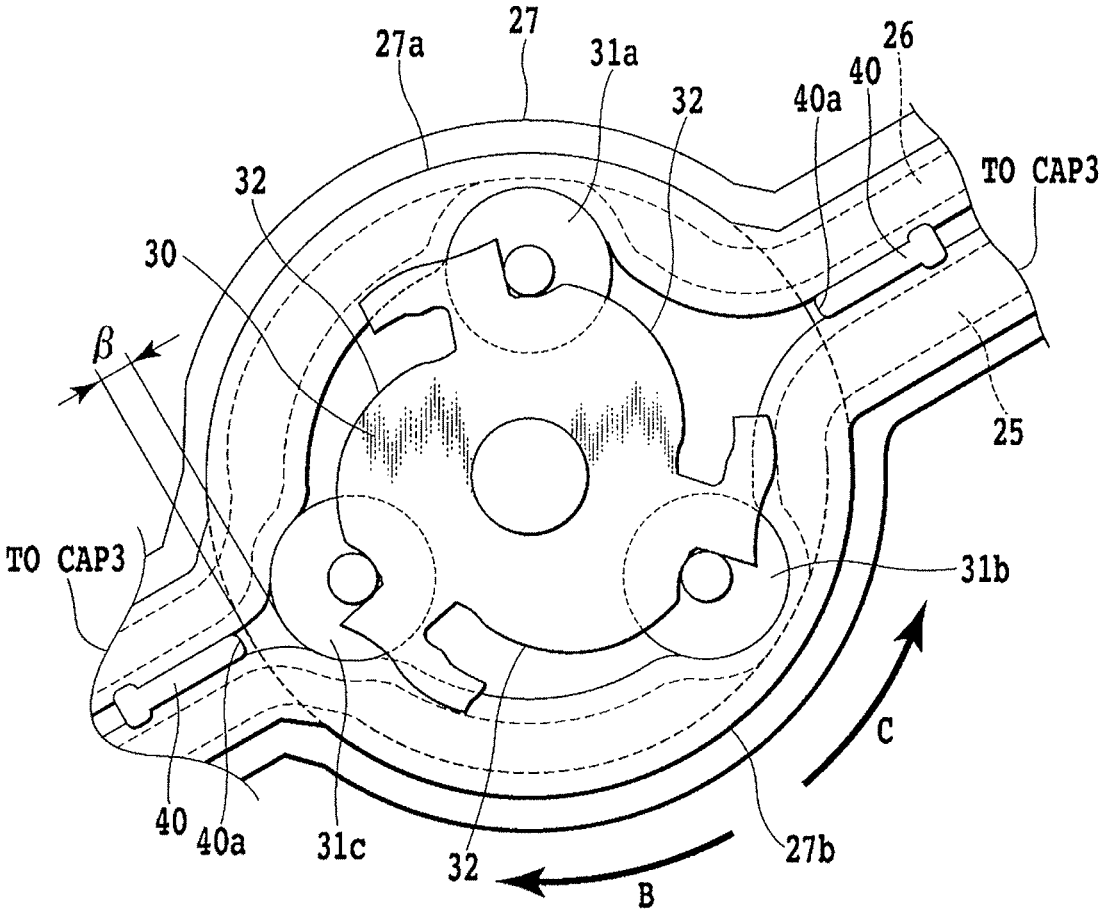
FIG. 9 is a schematic sectional view showing the operation of the tube pump in a state that one roller presses down a tube, the succeeding roller with respect to rotation presses the same roller and the remaining roller presses the other tube.
Figure 10:
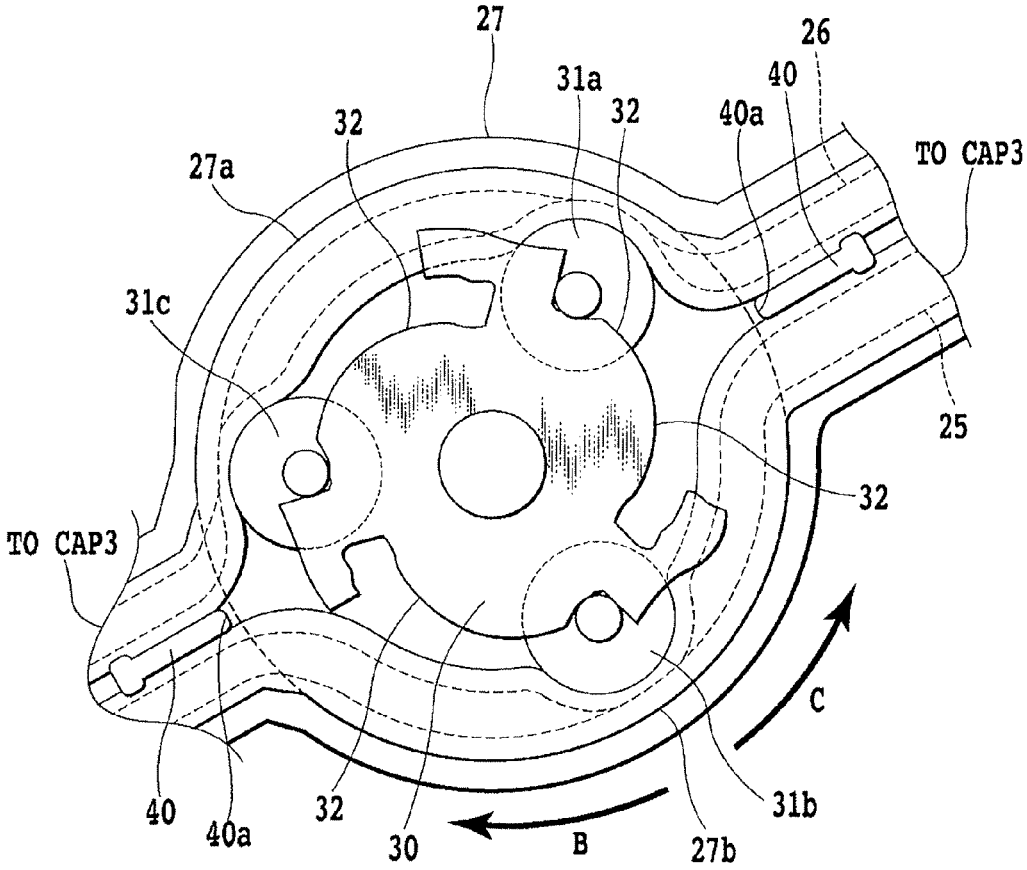
FIG. 10 is a schematic sectional view showing the operation of the tube pump in a state that one roller presses down a tube, the succeeding roller with respect to rotation presses the same tube and the remaining roller presses the other tube, similarly to FIG. 9.

FIGS. 9 and 10 are views showing the states in this duration. More specifically, the state changes from that shown in FIG. 8 into states shown in FIGS. 9 and 10 sequentially. In those states, the roller 31*a* presses the tube 26 while the subsequent roller 31*c* with respect to rotation is also pressing the tube 26. Further, the remaining roller 31*b* is in a state of pressing the other tube 25.

Figure 11:
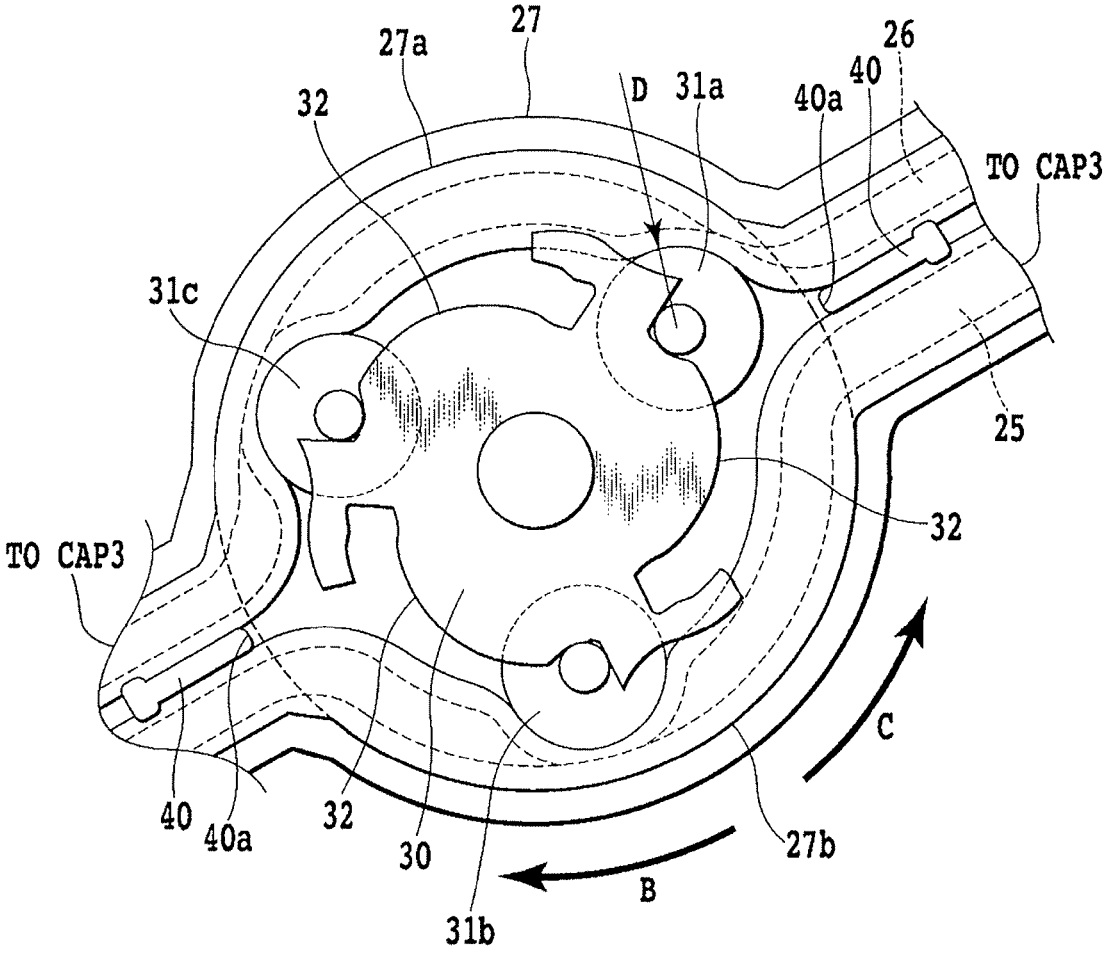
FIG. 11 is a schematic sectional view showing the operation of the tube pump in a state that one roller begins decreasing its pressing force in relation to the form of the tube guide.
Figure 12:
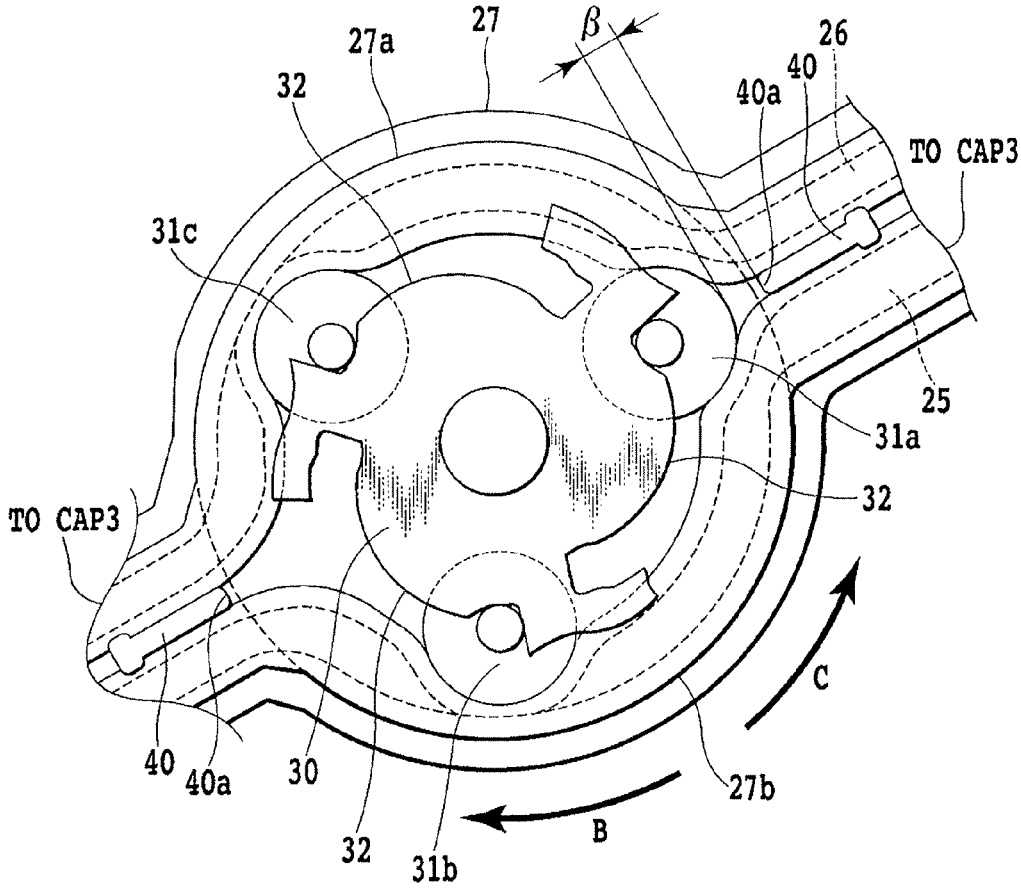
FIG. 12 is a schematic sectional view showing the operation of the tube pump in a state that one roller reached the introduction portion following the FIG. 11 state.
Figure 18:
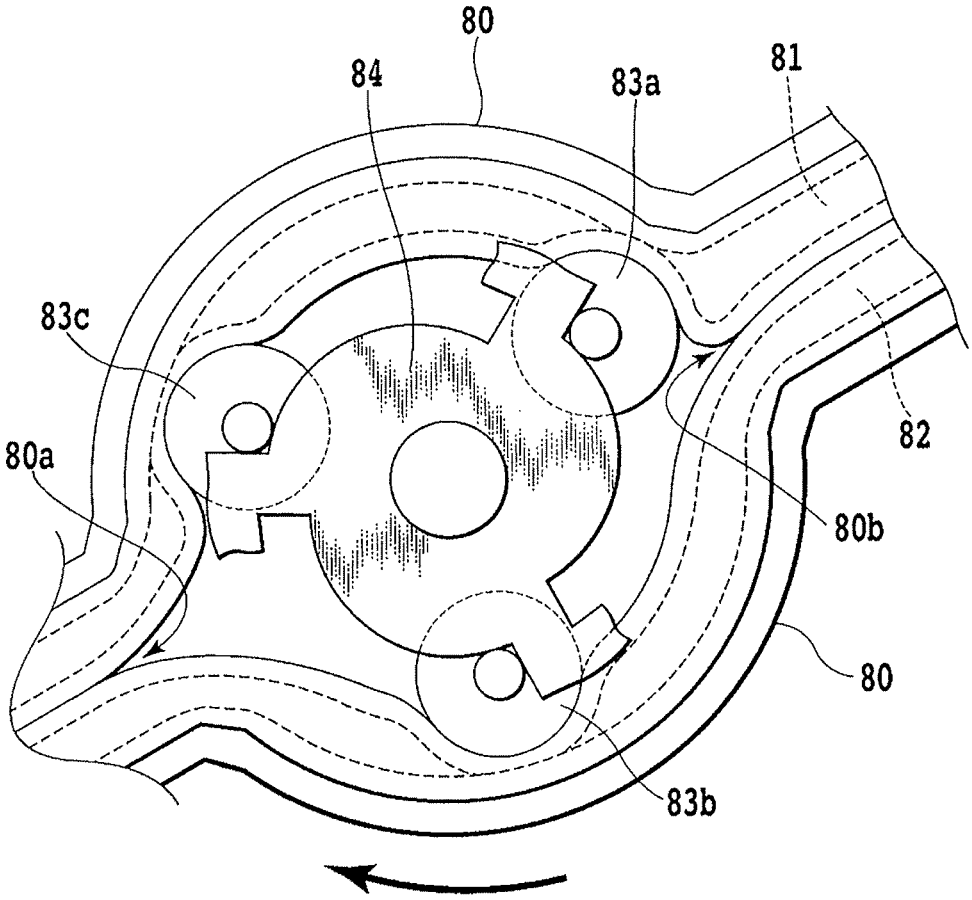
FIG. 18 is a schematic sectional view explaining a tube pump as a prior art.

When the roller holder 30 further rotates in the arrow B direction, the roller 31*a* begins decreasing its pressing force in relation to the shape of the guide 27*a* as shown in FIG. 11, finally reaching the introduction portion 30*a* (see FIG. 4) shown in FIG. 12. In the transition from the state shown in FIG. 11 to that shown in FIG. 12 in this manner, in the case of employing the traditional tube pump structure as shown in FIG. 18, the roller 31*a* may drag the pump tube 26 into the introduction portion thereby increasing the load on the pump motor.

On the contrary, in the first embodiment of the invention, guide members 40 are disposed in the respective introduction portions at between the guides 27*a* and 27*b*. Specifically, the guide members 40 are arranged to extend from the neighborhood 40*a* of the extended portion of the inner circumference surfaces of the arcuate guides 27*a*, 27*b*, along a radial direction with respect to the center of the circumference. Due to this, the pump tube which the roller 31*a* tries to drag is sustained by the guide member 40, to prevent the tube from increasing its deformation due to dragging. Thus, the tube can be prevented from being dragged in a manner forming a resistance to the roller. As a result, the pump motor, etc. can be prevented from being burdened with an increasing load.

Further, where the tube is prevented from being dragged as above, the roller 31*a* in a state subsequent to that shown in FIG. 11 undergoes force acting in an arrow D direction due to the elastic restoring force of the tube 26. At this time, the force of the arrow D direction acts in a direction approximate to the direction along the guide groove 32 of the roller holder 30 (in the direction along which the roller 31*a* is allowed to move). Consequently, in the case of merely forming a guide groove as in the traditional tube pump shown in FIG. 18, the roller 31*a* is rebounded along the guide groove 32. As a result, the roller 31*a* hits a part of the roller holder 30 or so, thus causing impact sound.

On the contrary, in the first embodiment of the present invention, the guide groove 32 is structured in such a shape that the roller 31 contacts simultaneously with the adjacent two pump tubes 25, 26 at the introduction portion between the guides 27*a* and 27*b* while undergoing the reaction force of the pump tube 26, as described below.

Figure 6:
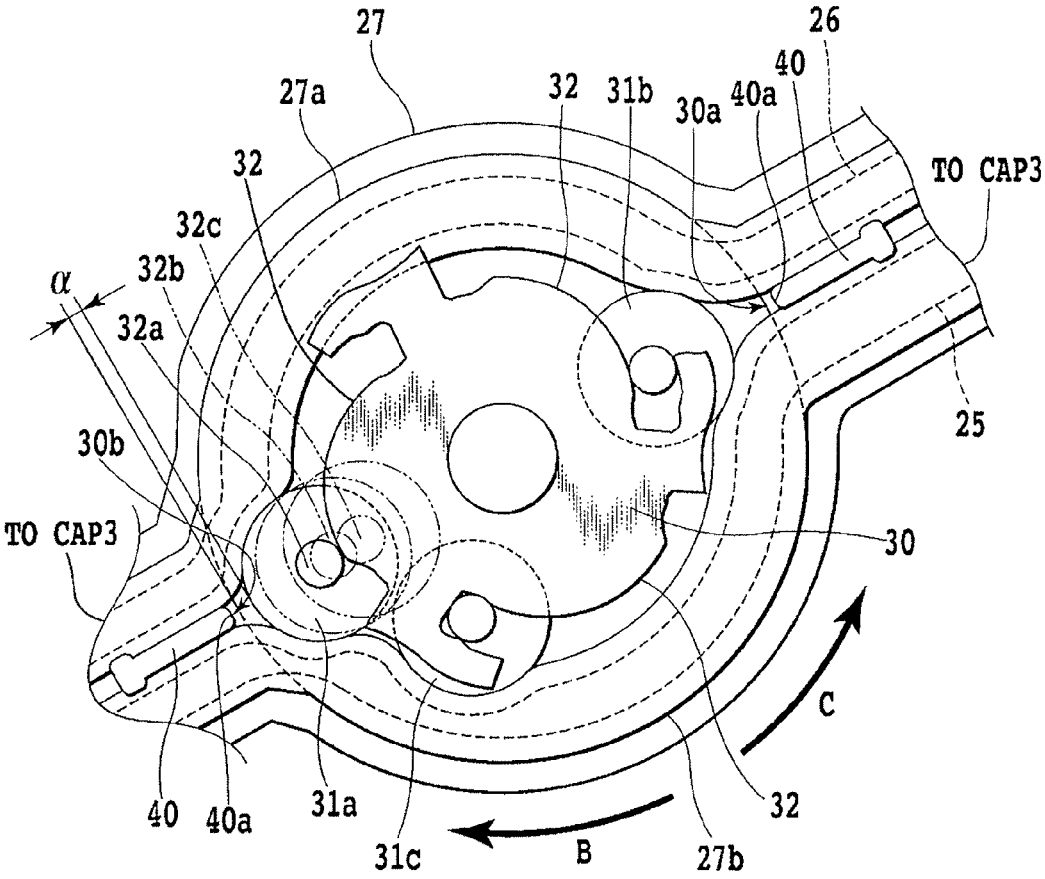
FIG. 6 is a schematic sectional view showing the operation of the tube pump in a state moving to a tube open position alter pumping operation.

Now description is made concretely on the shape or geometry of the guide groove 32 according to the embodiment. As shown in FIGS. 7 to 9 and 12, there exists a first position 32*b* (see FIG. 6) where the roller 31*a* presses the pump tube 26, i.e. the distance of the outer peripheral surface of each roller to an inner peripheral surface of the guide 27*a*, 27*b* or a circumferential surface extending therefrom is β. Further, as shown in FIG. 5, there exists a second position 32*c* (FIG. 6) where the roller 31*a* leaves from and releases the pump tube 26, i.e. the distance of the outer peripheral surface of each roller to the inner peripheral surface of the guide 27*a*, 27*b* or a circumferential surface extending therefrom is γ. Furthermore, between the position with a distance β and the position with a distance γ, there is a third position 32*a* (FIG. 6) where the roller 31*a* has greater pressing force on the pump tube than that upon generation of a suction force thus becoming an over-pressing state, as shown in FIG. 6. That is, at the third position, the distance of the outer peripheral surface of each roller to the inner peripheral surface of the guide 27*a*, 27*b* or a circumferential surface extending therefrom is α. In the embodiment, the groove 32 is determined in a shape such that the three positions are in a relationship of $\alpha<\beta<\gamma$.

Specifically, an inner portion of the groove 32 (hereinafter, referred to as a cam surface) has the distance from the rotation center of the holder which continuously increases from the point, where the roller is located at the first position 32*b* with a distance β (e.g. position of the roller 31*a* shown in FIG. 7), and reaches the third position 32*a* with a distance α (e.g. position of the roller 31*a* shown in FIG. 6). The distance of the cam surface of the groove 32 from the rotation center continuously decreases from this maximum distance and finally reaches the se o rid position 32*c* with the distance γ (position of the roller 31*a* shown in FIG. 5). In this manner, the cam surface is given with such a shape that the third position 32*a* exists which corresponding to an over-pressing state (maximum distance) next to the first position 32*b* of the roller pressing the pump tube. Due to this, the roller trying to move under the rebound force of from the pump tube, is sustained on the cam surface connecting between the point of the groove 32 forming the first position 32*b* and the point of the groove 32 forming the third position 32*a*. That is, the roller, trying to move under the rebound force can be prevented from moving by the cam surface increasing the distance. As a result, the roller can be gradually released from the engagement with the pump tube while being substantially held in the first position 32*b*, thus preventing against abrupt roller movement and the resulting generation of impact sound.

Next description is made on the operation in which the roller holder 30 is rotated reverse in an arrow C direction (FIG. 4, etc.) by the reverse rotation of the motor. After completing the above described pumping operation, when the roller 31*a* is at, rest in a tube-pressing position (the first position 32*b*) as shown in FIG. 8, the roller 31*a* could not get over the third position 32*a* where it is in an over-pressing state even if the roller holder 30 is rotated in the arrow C direction. As a result, while substantially staying in the first position 32*b*, the roller 31*a* moves reverse to reach a position (FIG. 7) where the roller contacts simultaneously with the adjacent two pump tubes 25, 26 at the introduction portion between the guides 27*a* and 27*b*. This allows the roller 31*a* to radially move in a certain degree. Here, when the roller is rotated reverse in the arrow C direction, the roller 31*a* stays at the introduction portion and gets across the third position 32*a* and finally moves to the second position 32*c* by the relative movement to the groove 32. As a result, as shown in FIG. 5, the rollers are allowed to place the pump tubes 25, 26 in the open state.

Figure 13:
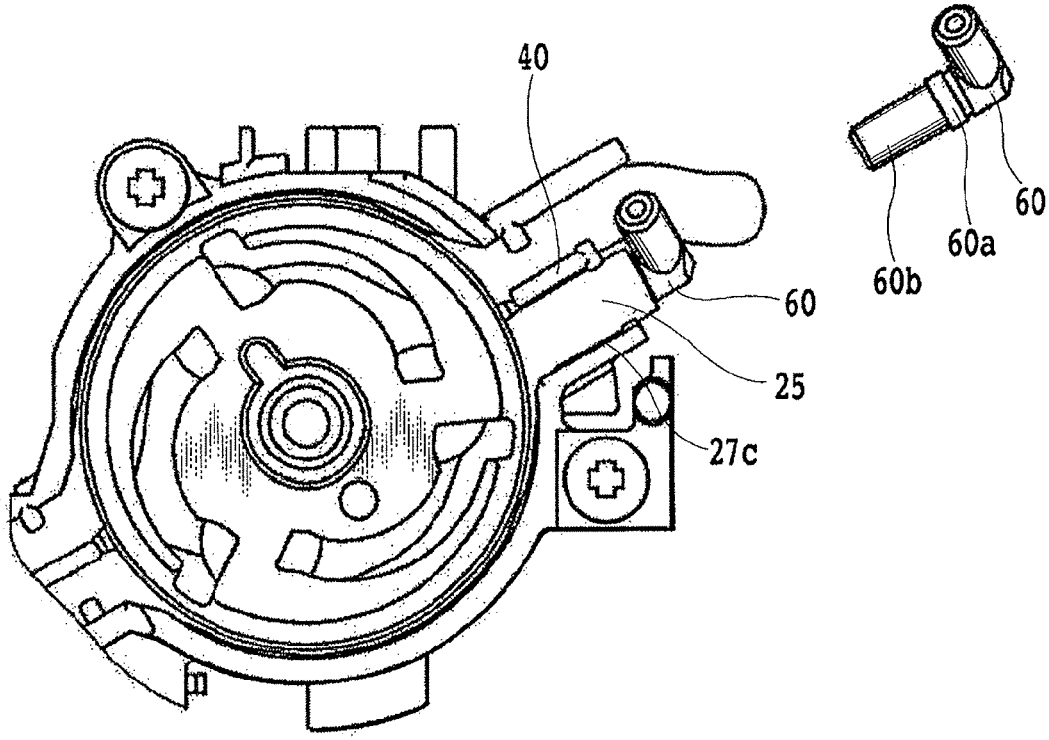
FIG. 13 is a schematic sectional view showing a joint of the tube pump according to a first embodiment of the invention.
Figure 14:
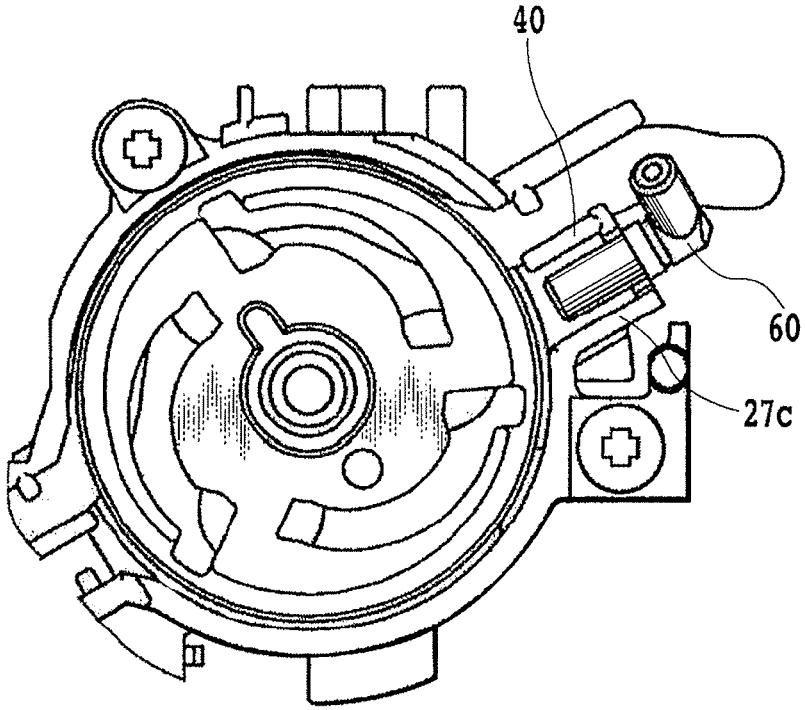
FIG. 14 is a schematic sectional view showing the joint of the tube pump according to the first embodiment of the invention.
Figure 15:
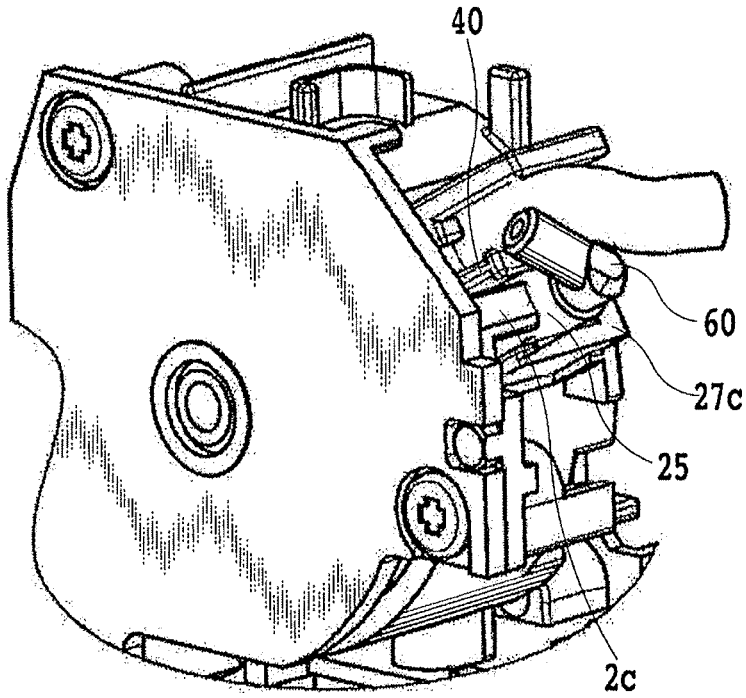
FIG. 15 is a schematic sectional view showing the joint of the tube pump according to the first embodiment of the invention.

FIGS. 13 to 15 are views showing the joint structure of the tube pump according to the embodiment. The maintenance and positioning is as follows, as to the pump tube 25 using a joint 60 in the tube introduction portion given as a limited space as shown in FIG. 13. The joint 50 has a larger diametrical portion 60*a* and a smaller diametrical portion 60*b*, to be fit in an inner diametrical portion of the pump tube 25. Its fit region is inserted in a space sandwiched between the guide 40 and the opposite wall 27*c*, formed in a part of the pump space 27. In this case, the larger diametrical portion 60*a*, of the joint 60 attached to the pump tube 25, is determined in position by an end 27*d* of the pump base, as shown in FIG. 14. As shown in FIG. 15, the fitting, of between the pump tube 25 and the smaller diametrical portion 60*b* of the joint 60, is made compatible with both its position and maintenance by being structured clamped in the space sandwiched by the projection 2*c* formed in a part of the base 2 and the wall 27*c*.

(Second Embodiment)

Figure 16:
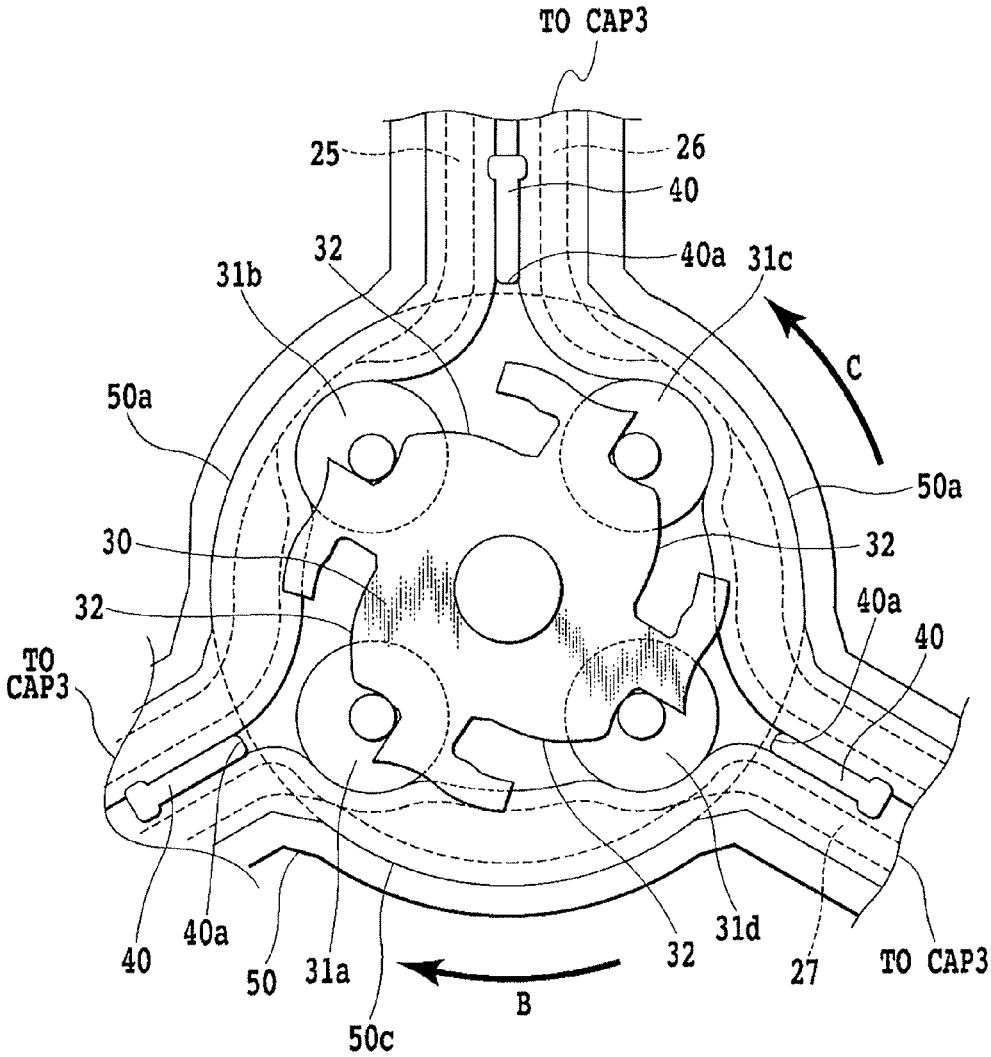
FIG. 16 is a schematic sectional view showing a tube pump according to a second embodiment of the invention.

FIG. 16 is a schematic sectional view showing a tube pump according to a second embodiment of the present invention. The difference from the first embodiment lies in the number of pump base 50 divisions. More specifically, the first embodiment is structured with two pump tubes and three rollers whereas this embodiment is structured with three tubes (25, 26, 27) and four rollers (31*a*, 31*b*, 31*c*, 31*d*). In such a structure as is different in the number of tubes, the tubes can be prevented from being dragged by providing respective guide members at three introduction portions. Further, by forming three grooves 32 of the roller holder 30 as a cam-surface shape as explained in the first embodiment, the rollers can be prevented from moving abruptly due to the rebounding of from the tubes.

(Other Embodiments)

Although the foregoing embodiment concerns the tube pump having a plurality of tubes, the present embodiment is not limited to such a form. Even for the arrangement form with one tube in a tube pump as disclosed in Japanese Patent Laid-Open No. 2002-036601, the tube can be prevented from being dragged by providing a guide member in an introduction portion of the tube. Further, by defining the roller-holder groove with such a shape as explained in the foregoing embodiment, abrupt unstable behavior can be prevented from occurring due to a tube's rebound force upon movement of the roller to an introduction portion after completing the pressing on the tube.

In addition, it is natural that the guide member 40 is not limited in form to the showing in FIG. 4, etc. It may be in any form provided that can sustain the tube and prevent the tube from increasingly deforming due to the dragging thereof in the course of movement of the roller to the introduction portion.

The foregoing embodiment explained the serial printing scheme that printing is by moving the printing head in the main scanning direction. This however is not limitative. Namely, application is possible also to an apparatus of a full-line scheme that printing is by feeding a printing medium relative to a printing head whose ejection openings are arranged in a region over all or a part of the printing medium. In this case, the tube pump in the embodiment of the invention may be provided as a pressurization type, i.e. ink circulation flow is caused in its common liquid chamber of the printing head, instead of the suction type. Meanwhile, it is natural that the invention is applicable not only to an ink jet printing apparatus using one printing head but also to a color ink jet printing apparatus for use in printing with different-color inks. Meanwhile, application is possible regardless of the number or type of printing heads, e.g. an ink jet printing apparatus using inks same in color but different in concentration, or an ink jet printing apparatus as a combination of those.

Furthermore, the invention is to be applied similarly to various forms of the printing head and ink reservoir, e.g. a form having an exchangeable ink jet cartridge whose ink ejector and ink reservoir are integrated together, or a form whose printing head is fixed on the apparatus. Furthermore, the invention is to be applied similarly to those using a printing head using electromechanical transformers, e.g. piezo elements.

As apparent from the descriptions made so far, the embodiment of the invention can prevent the pump-drive load from increasing by sustaining, with the guide member, the pump tube to be drawn to the tube introduction portion by the roller.

Meanwhile, roller impact sound can be eliminated of occurring. Due to this, impact sound occurrence can be prevented upon roller movement by means of a simple structure without resorting to a buffer material.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-227182, filed Aug. 23, 2006, which is hereby incorporated by reference herein in its entirety.

What is claimed is:

1. An ink jet printing apparatus that uses a printing head and ejects ink onto a printing medium from the printing head to perform printing, said apparatus comprising:

a tube pump for causing a pressure change of ink in an ink ejection opening of the printing head to suck ink, said tube pump including:

N tubes, N being equal to or greater than 2,

N+1 rollers, a roller holder which holds the rollers, such that when the roller holder rotates in a forward direction, the rollers press the tubes and negative pressure is generated in the tubes, a tube guide having an inner circumferential surface and receiving the tubes pressed by the rollers to maintain a positional relationship with the rollers pressing the tubes, wherein the N tubes are arranged along a same imaginary plane that intersects a rotation axis of the roller holder, wherein for each of the N+1 rollers, the roller holder has a corresponding groove engaging with a rotation shaft of the roller, wherein each roller is moved by rotation of the roller holder and a movement of the roller relative to a cam surface of the corresponding groove through the rotation shaft, and wherein each groove has a pressing position of the cam surface that defines (i) a position of the corresponding roller where the roller presses a tube and (ii) a distance of an outer peripheral surface of the roller to a rotation center of the roller holder is a first distance, and an over-pressing position of the cam surface that defines (i) a position of the roller where the roller over-presses the tube and (ii) a distance of an outer peripheral surface of the roller to the rotation center of the roller holder is a second distance that is greater than the first distance;

an introduction portion through which a pair of the tubes is introduced from an outside of the tube guide and at which one of the rollers comes into contact with the pair of the tubes, which are arranged along the same imaginary plane, simultaneously when the roller holder rotates in the forward direction; and a guide member supporting the pair of the tubes, which are arranged on the same imaginary plane, therebetween at a neighborhood of the introduction portion, the guide member being arranged to extend from a neighborhood of an extended portion of the inner circumferential surface, along a radial direction with respect to a center of a circle formed with the inner circumferential surface.

2. An ink jet printing apparatus as claimed in claim 1, further comprising a cap for covering a face of the printing head on which the ink ejection opening is arranged, wherein one end of each of the N tubes communicates with an inside of the cap for sucking ink in the ink ejection opening by a pump operation of said tube pump.

3. An ink jet printing apparatus as claimed in claim 1, wherein each groove has a release position of the cam surface that defines (i) a position of the corresponding roller where the roller does not press the tube and (ii) a distance of the outer peripheral surface of the roller to the rotation center of the roller holder is a third distance that is smaller than the first distance.

4. An ink jet printing apparatus as claimed in claim 1, wherein said tube pump includes N introduction portions.

5. A tube pump comprising:

N tubes, N being equal to or greater than 2;

N+1 rollers;

a roller holder which holds the rollers, such that when the roller holder rotates in a forward direction, the rollers press the tubes and negative pressure is generated in the tubes, a tube guide having an inner circumferential surface and receiving the tubes pressed by the rollers to maintain a positional relationship with the rollers pressing the tubes, wherein the N tubes are arranged along a same imaginary plane that intersects a rotation axis of the roller holder, wherein for each of the N+1 rollers, the roller holder has a corresponding groove engaging with a rotation shaft of the roller, wherein each roller is moved by rotation of the roller holder and a movement of the roller relative to a cam surface of the corresponding groove through the rotation shaft, and wherein each groove has a pressing position of the cam surface that defines (i) a position of the corresponding roller where the roller presses a tube and (ii) a distance of an outer peripheral surface of the roller to a rotation center of the roller holder is a first distance, and an over-pressing position of the cam surface that defines (i) a position of the roller where the roller over-presses the tube and (ii) a distance of an outer peripheral surface of the roller to the rotation center of the roller holder is a second distance that is greater than the first distance;

an introduction portion through which a pair of the tubes is introduced from an outside of the tube guide and at which one of the rollers comes into contact with the pair of the tubes, which are arranged along the same imaginary plane, simultaneously when the roller holder rotates in the forward direction; and a guide member supporting the pair of the tubes, which are arranged on the same imaginary plane, therebetween at a neighborhood of the introduction portion, the guide member being arranged to extend from a neighborhood of an extended portion of the inner circumferential surface, along a radial direction with respect to a center of a circle formed with the inner circumferential surface.

6. A tube pump as claimed in claim 5, wherein each groove has a release position of the cam surface that defines (i) a position of the corresponding roller where the roller does not press the tube and (ii) a distance of the outer peripheral surface of the roller to the rotation center of the roller holder is a third distance that is smaller than the first distance.

7. A tube pump as claimed in claim 5, wherein said tube pump includes N introduction portions.

8. An ink jet printing apparatus as recited in claim 1, wherein when the roller holder rotates in a reverse direction opposite to the forward direction, each of the rollers moves in a direction such that a pressing force by the rollers on the tubes decreases to relieve negative pressure in the tubes.

9. A tube pump as recited in claim 5, wherein when the roller holder rotates in a reverse direction opposite to the forward direction, each of the rollers moves in a direction such that a pressing force by the rollers on the tubes decreases to relieve negative pressure in the tubes.

* * * * *